United States Patent [19]

Barlow

[11] Patent Number: 4,757,733

[45] Date of Patent: Jul. 19, 1988

[54] PUNCH

[75] Inventor: Terence Barlow, Failsworth, England

[73] Assignee: Perforex Limited, Gorton, England

[21] Appl. No.: 46,093

[22] Filed: May 5, 1987

[51] Int. Cl.[4] ..... B26D 5/08

[52] U.S. Cl. ..... 83/588; 83/618; 83/633; 83/698

[58] Field of Search ..... 83/558, 467, 618, 633, 83/698; 72/254, 255, 253.1

[56] References Cited

U.S. PATENT DOCUMENTS

| | | | |
|---|---|---|---|
| 2,449,108 | 9/1948 | Carlock | 83/588 |
| 2,717,643 | 9/1955 | Marano | 83/588 |
| 3,073,199 | 1/1963 | Yerkes | 83/588 |
| 3,176,570 | 4/1965 | Gaya | 83/588 |
| 4,036,088 | 7/1977 | Ruskin | 83/588 |
| 4,116,030 | 9/1978 | Kobayashi et al. | 72/253.1 |
| 4,466,322 | 8/1984 | Mori | 83/588 |
| 4,656,907 | 4/1987 | Hymmen | 83/588 |

*Primary Examiner*—E. R. Kazenske
*Assistant Examiner*—Scott A. Smith
*Attorney, Agent, or Firm*—Dennison, Meserole, Pollack & Scheiner

[57] ABSTRACT

A punch main body, consisting of a base portion and a support portion, is formed from one or two extruded profiles, for example of aluminium. Respective end plates, for example of moulded plastics, are preferably fitted to the ends of the profile (5) to maintain overall strength and rigidity so that the thickness of the extruded material can be reduced. A pivotal press bar, which may also be an extruded profile, is effective to move cutting tools downwards through openings in the punch main body. The length of the extruded profile (5) and the positioning thereon of the openings for the cutting tools can be varied without the need for new production moulds, thereby simplifying and reducing the cost of production of a range of different sizes of punch.

20 Claims, 4 Drawing Sheets

PUNCH

TECHNICAL FIELD

This invention concerns a punch, more especially a manually operable punch of the type commonly used in offices, schools and similar establishments to form appropriately spaced holes in marginal edge regions of one or more sheets of paper to enable such sheets to be inserted into a loose-leaf binder.

BACKGROUND ART

Known punches of this type generally comprise a stationary base plate from which two upstanding side supports project. The side supports are sometimes integrally formed with the base plate, but are more often in the form of separate mirror image brackets welded to the base plate. Respective cylindrical cutting tools with downwardly directed cutting edges are mounted in the side supports and are axially movable against spring force upon depression of a handle or press bar which is pivotally connected between the side supports. When the press bar is actuated the tools are simultaneously pushed downwards so that their cutting edges co-operate with respective apertures in the base plate to cut holes in any sheets of paper inserted into a throat area between the side supports and the base plate.

Although two cutting tools are most common in punches of this type, any desired number may be provided. Moreover, three-or four-tool punches are particularly common in countries such as France, Sweden and U.S.A. to cut holes to correspond with standard binders used in those countries.

In addition to the variation in the number of cutting tools, the spacing between the respective cutting tools may vary to match the spacing of fastening means in different types of loose-leaf binders. In all, about nine different sizes of punch are currently on the market to cater for the varying requirements.

At present, the main structural components for punches of the type just described, namely the base plate, the side support brackets and the press bar, are individually cast or otherwise fabricated from mild steel. In addition, a tray moulded from plastics material is usually fitted to the underside of the base plate to retain the waste cuttings. Although the aforesaid mild steel construction gives the punch the necessary strength for cutting through several mm of paper, the cost of tooling up for fabricating components for one size of punch (i.e. one particular cutting tool spacing) amounts to many thousands of pounds. The cost of obtaining a mould for the tray is also very expensive. Accordingly, many manufacturers do not produce less popular punch sizes because it is not economically feasible to do so.

It is an object of the present invention to propose a novel design of punch which will allow manufacture by less expensive methods and with materials of less inherent strength than hitherto.

BRIEF SUMMARY OF THE INVENTION

With this object in view the present invention provides a punch comprising a support portion disposed above a base portion with respective parts of the support portion and the base portion juxtaposed to form a throat region and also constituting upper and lower cutting tool guide means, and a pivotal press bar whereby one or more spring-loaded cutting tools are pushed through openings in the aforesaid guide means, characterised in that the support portion and the base portion are formed as a single extruded profile, or as respective extruded profiles.

Respective end plates are preferably fitted onto opposing ends of the extruded profile or profiles so that the thickness of the extruded material (and hence the cost thereof) can be reduced while the overall strength and rigidity of the device is maintained.

Preferably, the press bar is formed as a separate extruded profile pivotally mounted between the respective end plates.

The extruded profile or profiles making up the main body of the punch (i.e. the base portion and the support portion) and the other extruded profile which constitutes the press bar are preferably formed of aluminium, although other extrudable materials are possible. Although aluminium is currently a more expensive material than mild steel, the cost of providing extrusion dies is so much less than the cost of tooling up for production of steel components that the overall cost of production of the proposed punch is less than that of conventionally constructed punches. What is even more significant is that punches of different sizes can readily be produced simply by using the same end plates and different lengths of the same extruded profiles, and by forming holes therethrough for guidance and support of the cutting tools at different positions, whereas previously a completely new set of production tools had to be made for each size of punch (i.e. each variation in the size of the separate components, or the number or spacing of the cutting tools).

Although aluminium extrusions are inherently less strong than the previously used mild steel fabrications the use of end plates to support the profile or profiles making up the main body of the punch imparts sufficient rigidity to the device as a whole that relative thin aluminium can be used. These end plates advantageously have lateral flanges or ribs in contact with or engaging at least part of the edge margins of the said profile or profiles.

In the case where the base portion and the support portion are formed of separate extrusions, the latter in particular may be formed of plastics. This will reduce the cost of materials, yet in view of the end plate support will not be detrimental to the overall strength and rigidity of the device.

The end plates are preferably moulded from plastics, e.g. high stress glass fiber reinforced nylon. The plastics is conveniently coloured to avoid the need for any additional finish and further reduce production costs.

The punch preferably also includes a tray which is removably attached to the underside of the base portion to retain waste cuttings for periodic disposal. This tray is advantageously in the form of a plastics extrusion with respective locator ribs for reception of downwardly projecting legs of the base portion only at two opposing sides (usually its front and rear edges. This sort of extruded tray is considerably less expensive to produce than the previously known moulded plastics tray with an all-round rim and, of course, the length of the proposed tray can readily be varied to match the length of the extruded profiles used for different sizes of punch.

BRIEF DESCRIPTION OF THE DRAWINGS

The invention will be described further, by way of example, with reference to the accompanying drawings, in which.

DETAILED DESCRIPTION OF PREFERRED EMBODIMENTS

Figure 6:
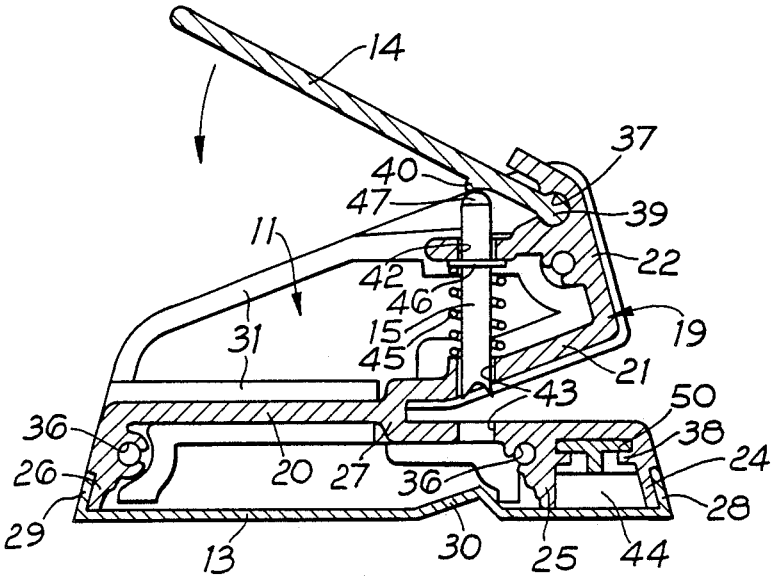
FIG. 6 is a cross-section of the said preferred embodiment of the punch of the invention showing how the components illustrated separately in FIGS. 1, 2, 3 and 5 are fitted together.
Figure 7:
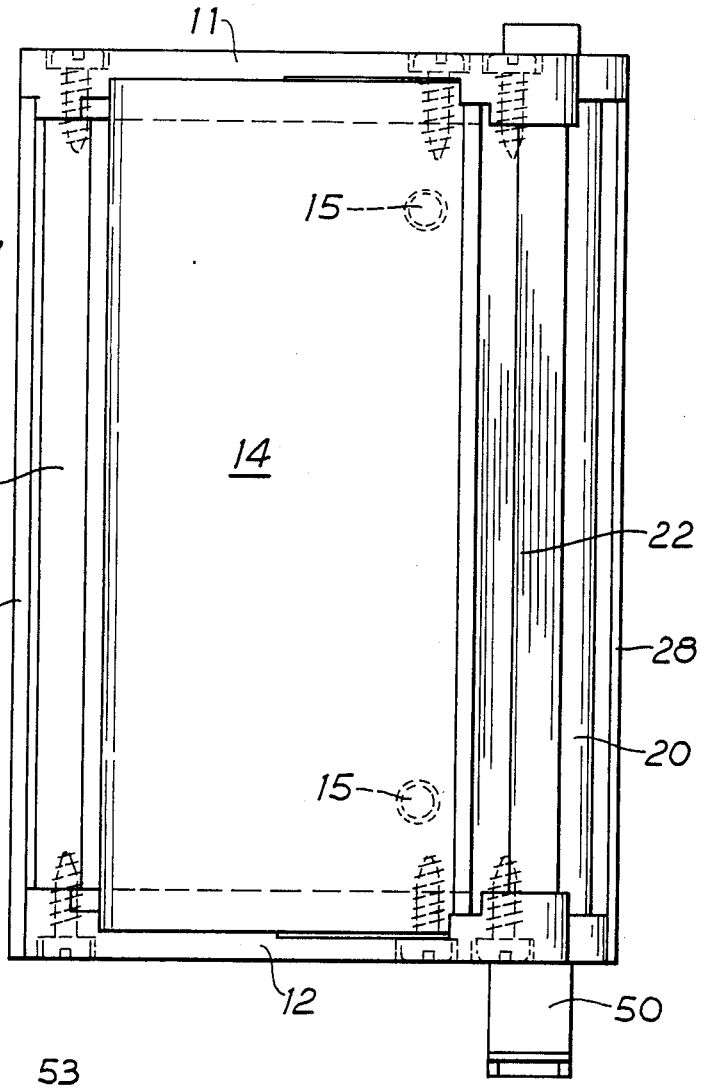
FIG. 7 is a plan view of the punch shown in FIG. 6.

As illustrated in FIGS. 1 to 7, a preferred practical embodiment of the punch of the invention comprises a main body profile 10 (FIG. 2), respective end plates 11 and 12 (FIGS. 1 and 4), a tray 13 (FIG. 3), a press bar 14 (FIG. 5) and two cylindrical cutting tools 15 assembled together as indicated in FIGS. 6 and 7.

Figure 2:
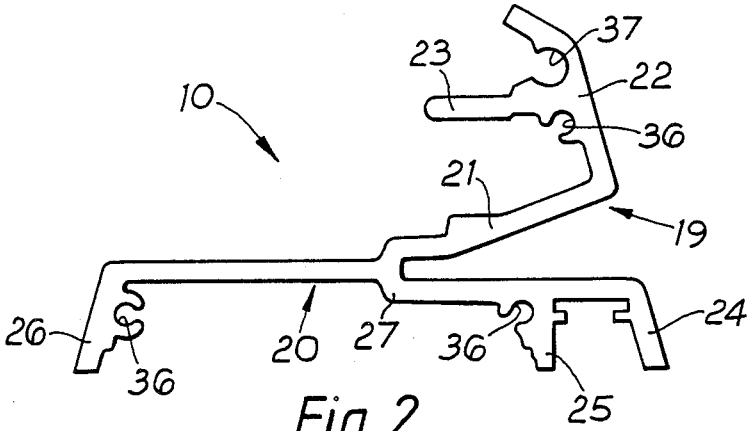
FIG. 2 is an end view of a first extruded profile constituting the main body of the same embodiment of the punch of the invention.
Figure 3:
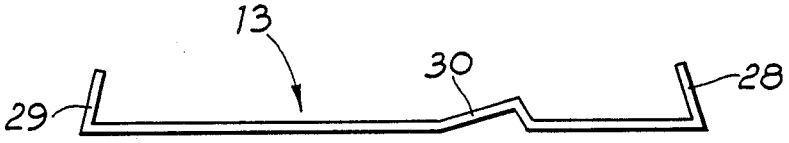
FIG. 3 is an end view of a tray to be fitted beneath the profile shown in FIG. 2.

With reference to FIG. 2, the main body profile consists of a single aluminium extrusion of any desired length. It can be approximately divided into a support portion 19 disposed above a base portion 20. The support portion 19 may in turn be subdivided into an upper cutting tool guide 21, and an upstanding front portion 22 having a rearwardly directed auxiliary cutting tool guide platform 23 extending therefrom. The base portion 20 is generally rectangular in plan and is provided with front, intermediate and rear downwardly directed legs, 24, 25, 26 respectively, to support the punch upon a flat surface, such as a desk top. The intermediate leg 25 is only a short spacing behind the front leg 24. It provides additional stiffening and also delimits a frontal space beneath the base portion 20 in which a paper gauge 50 may be located, as will be described later.

The base portion 20 has a substantially horizontal rear part which connects to a substantially horizontal front part by way of a downward step or joggle 27 approximately in the middle of the portion 20. The upper cutting tool guide 21 extends above the front part of the base portion 20 (which provides a power cutting tool guide) and inclines upwardly from the top of the step 27 until it merges into the upwardly projecting front portion 22 at a point lying above the region between the intermediate leg 25 and the front leg 24. The gap remaining between the front part of the base portion 20 (the lower cutting tool guide) and the upper cutting tool guide 21 forms the throat of the punch which receives edge margins of sheets of paper in which holes are to be cut, the edges of the paper being pushed into abutment against the step 27.

At its upper margin, the front portion 22 inclines rearwardly and on its inner surface, above the auxiliary guide platform 23, it is provided with a groove 37 of part-spherical cross-section for reception of a presser bar shaft, as mentioned hereinafter.

The tray 13 consists of a plastics extrusion which is cut so as to be slightly longer than the profile 10 and is fitted to the underside of the profile 10. The tray 13 has respective inwardly inclined locator ribs 28, 29 at front and rear for engagement over the front and rear legs 24, 26 of the profile 10. It also has an inclined deflector region 30 which is located beneath the throat of the punch and deflects waste cuttings falling through the base portion 20 of the profile 10 towards the rear of the tray 13 so that the tray 13 does not become clogged immediately below the throat.

Figure 1:
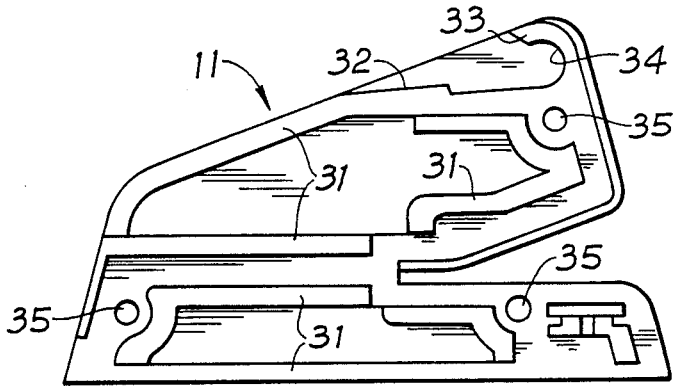
FIG. 1 is an inner side view of a left side end plate of a preferred practical embodiment of the punch of the invention.
Figure 4:
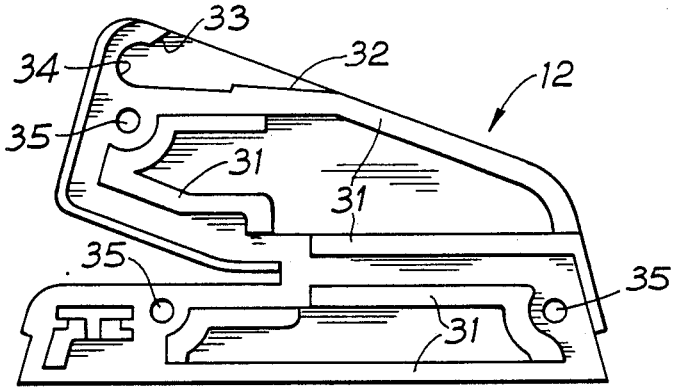
FIG. 4 is an inner side view of a right angle side end plate of the same embodiment of the punch of the invention.
Figure 5:
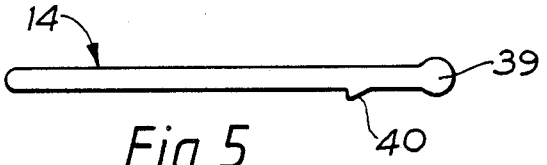
FIG. 5 is an end view of a second extruded profile which constitutes the press bar of the same embodiment of the punch of the invention.

The left and right side end plates 11, 12, each consisting of a tough coloured plastics moulding, are shown in FIGS. 1 and 4 respectively. Each plate 11, 12 is roughly triangular in shape with an apex towards the front of the punch. They are shaped to cover the respective ends of the profile 10 and are provided with an plurality of flanges or ribs 31 which project inwardly of the assembled punch and fit closely around most parts of the profile edge margins, as indicated in FIG. 4, to give support to same. In this way, the end plates 11, 12, when fitted onto the ends of the main body profile 10 impart strength and rigidity to the entire device.

The left and right side end plates 11, 12 are not exactly symmetrical mirror images as the left side end plate 11 is provided with a straight lower edge which abuts the end of the tray 13 which is fitted to the underside of the profile 10, whilst the right side end plate 12 has a lower edge which is shaped to finish just above its respective end of the tray 13. The tray 13 can thus be readily removed from the underside of the profile 10 to empty out accumulated waste cuttings by sliding it towards the right side end of the punch.

The end plates 11, 12 are also provided on their inwardly directed faces with upper and lower stops 32, 33 which serve to limit the pivotal movement of the press bar 14 (see FIG. 6). The lower stop 32 is provided by the upper surface of a flange where it is diverted inwardly from the rearwardly sloping upper edge of each end plate 11, 12. The upper stop 33 is provided by the lower edge of a flange which partially surrounds a press bar pivot point 34 near the apex of each end plate 11, 12.

The end plates 11, 12 are also provided with three fixing holes 35 in line with respective fixing grooves 36 formed on the main body profile 10. Screws or other fastening means may be used to secure the plates 11, 12 to the profile 10 by insertion through the holes 35 and engagement in the corresponding grooves 36.

The press bar 14 (FIG. 5) consists of a further aluminium extrusion of slightly greater length than the main body profile 10. An integral pivot shaft 39 is formed along one edge of the press bar 14 and adjacent this is a small ridge 40 which serves to contact and transmit pressure to the top of the cutting tools 15 (see FIG. 6).

The pivot shaft 39 fits into the groove 37 behind the upright front portion 22 of the main profile 10, by being slidingly inserted from one end, and is then retained between the respective pivot points 34 provided on the edge plates 11, 12.

With reference to FIG. 6, two appropriately spaced circular openings 42 are provided in the auxiliary guide platform 23 and, in vertical alignment therewith similar openings 43 are provided in the upper cutting tool guide 21 and in the front part of the base portion 20, which effectively constitutes a lower cutting tool guide as well as a cutting surface. Respective cylindrical steel cutting tools 15 with downwardly directed cutting edges are mounted in the openings 42 by means of encircling helical springs 45 which act between the upper cutting tool guide 21 and a circlip 46 attached to each tool 15 which is urged into abutment against the auxiliary guide platform 23. A rounded plastics cap 47 is provided at the top of each cutting tool 15 as a reliable contact surface for the ridge 40 of the handle 14.

When the press bar 14 is depressed (as indicated by the arrow in FIG. 6) the cutting tools 15 are moved downwards against the action of the springs 45 so that the cutting edges pass through the openings 43 and pierce any paper located in the throat of the punch. As soon as the press bar 14 is released the springs 45 return the tools 15 and the presser bar 14 to their original (upper) position. The circles of paper cut out by the interaction of the cutting edges of the tools 15 and the openings in the base portion 20 are deflected rearwardly by the deflector region 30 of the tray 13, which is periodically removed and emptied, by being slid off at the right hand end of the punch.

The mechanical stresses arising upon use of the punch are primarily borne by the respective end plates 11, 12 as the groove 37 at the upper edge margin of the front portion 22 simply serves as a guide for the pivot shaft 39 of the press bar 14. Other stresses on the main extruded profile 10 are also, in part, transmitted to the end plates 11, 12 by virtue of the interengagement of the support flanges or ribs 31 with the opposite ends of the profile 10.

Figure 9:
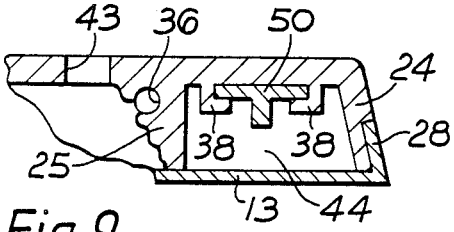
FIG. 9 is an enlarged view, similar to the lower right hand portion of FIG. 6, illustrating the position of a paper gauge in a modified embodiment of the punch of the invention.
Figure 10:
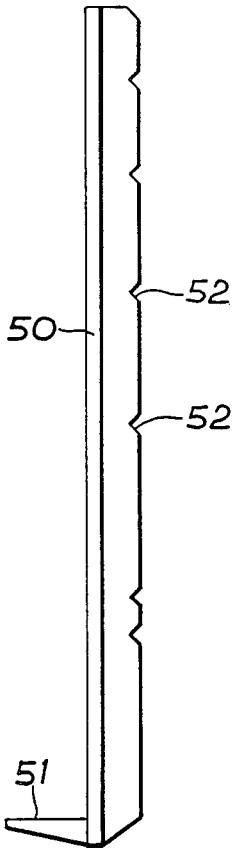
FIG. 10 is a reduced scale side view of the paper gauge indicated in FIGS. 6 and 7.
Figure 11:
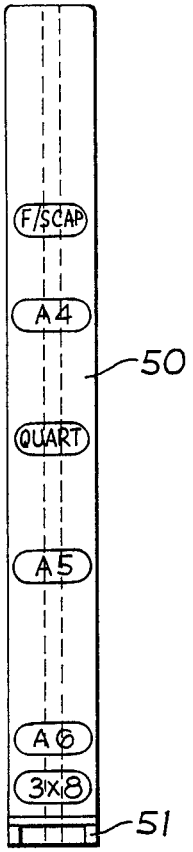
FIG. 11 is a top side view of the same paper gauge.

Optionally, a slidably extensible paper gauge 50, which serves for alignment of sheets of paper so that holes are formed in the correct position relative to one end thereof, may be provided in the frontal space 44 between the front leg 24 and the intermediate leg 25 of the base portion 20, as indicated in FIGS. 6, 7 and 9. Such a gauge 50 is illustrated in FIGS. 10 and 11. It is in the form of a thin plastics strip of T-shaped cross-section which can be pulled through apertures in the end plates 11, 12 by a user holding a terminal ridge 51, and can be temporarily retained at appropriate positions by engagement of one of a plurality of notches 52 formed in its vertical limb with the lower edge of one of the apertures. Appropriate ribs or flanges 38 are provided on the profile 10, in the area 44, to form a T-shaped slot for accommodating this gauge 50.

It should be appreciated that the invention is not limited to the exact details of the above-described embodiment and many variations are possible. In particular, if three or four cutting tools are required they can readily be mounted in similar manner to the two tools in the above-described embodiment and appropriate openings formed in the cutting tool guide, and the guide platform and the base portion. For different tool spacings, the openings are simply formed as required in the extruded profile 10 and of course the length of the profile 10 and of the tray 13 and the presser bar 14 can be chosen to accommodate wider spacings and/or more cutting tools for larger size punches.

Figure 8:
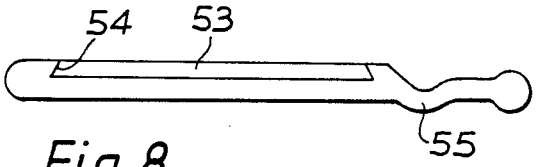
FIG. 8 is an end view of an alternative construction of press bar.

A slightly modified presser bar is illustrated in FIG. 8. This has a decorative PVC (polyvinyl chloride) panel 53 fitted into an appropriately shaped recess 54 in its upper surface. Also, in place of a ridge 40, it has an arcuate portion 55 for contact with the tops of the cutting tools. This presser bar can, of course, be used in place of the bar 14 in the above-described embodiment.

Figure 12:
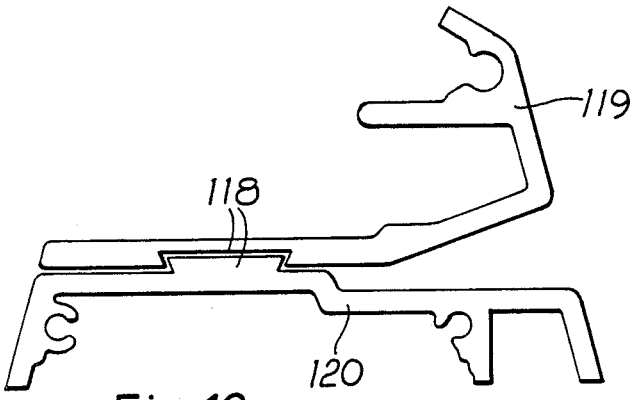
FIG. 12 is a schematic end view of two interengaged profiles constituting the main body of an alternative embodiment of the punch of the invention.

In a more significantly different embodiment of the invention, the base portion 120 and the support portion 119 of the main body of the punch may be formed as separate extrusions, the former of aluminium and the later of plastics. These are advantageously shaped for mutual interengagement e.g. by dovetail portions 118 as indicated in FIG. 12. The strength and rigidity of the punch is still maintained by end plates which have appropriately spaced ribs 31 to accommodate the broader central region where the two extrusions are in engagement. Otherwise, the principles of construction would be exactly as in the above-described embodiment. Although an extra extrusion die would be required, the use of plastics for one of the extrusions would reduce the cost of materials.

I claim:

1. In a punch comprising:

a base portion, a support portion extending upwardly from said base portion, said base portion and said support portion including respective sections juxtaposed to define a throat region of the punch;

means defining aligned openings in said juxtaposed sections;

cutting tools mounted in said aligned openings;

spring bias means biasing said cutting tools upwardly;

and a press bar mounted on said support portion so as to pivot relative thereto, and, upon pivoting downwardly, to push said cutting tools against said spring bias means downwards through said aligned openings;

the improvement wherein said base portion and said support portion terminate in opposed free ends and are of constant cross-section throughout their lengths and free ends, a pair of separate end plates, a fastener means mounting said end plates on the opposed free ends of the portions, said end plates overlying said free ends and having means extending laterally inward of the free ends and cooperating with said free ends for supporting and rigidifying said base and support portions with said respective sections in juxtaposition to define said throat region.

2. A punch as set forth in claim 1 wherein said means for supporting and rigidifying said base conceal the free ends of said portions.

3. A punch as set forth in claim 2 wherein said means for supporting and rigidifying said base and support portions comprise lateral flanges on each end plate extending inward of the free ends and overlying said base and support portions adjacent said free ends.

4. A punch as set forth in claim 3 wherein said press bar terminates in opposed free ends and is of a constant cross-section throughout its length and free ends.

5. A punch as set forth in claim 4 wherein at least some of said flanges on said end plates provide stop means for limiting the pivoting movement of said press bar.

6. A punch as set forth in claim 5, wherein said press bar is longer than said support portion and projects beyond each end of said support portion, and bearing means on said end plates for said press bar for transmission of force from said press bar to said end plates as said press bar is pivoted downwardly.

7. The punch of claim 6, wherein said base portion and said support portion are integral and defined by a single extrusion.

8. The punch of claim 1, wherein said press bar terminates in opposed free ends and is of a constant cross-section throughout its length and free ends.

9. The punch of claim 8, wherein said press bar is longer than said support portion and has the opposed free ends received in and pivotally supported by said end plates.

10. A punch as set forth in claim 8 wherein said end plates are of moulded plastics material.

11. A punch as set forth in claim 10 further including a tray removably attached to the underside of said base portion, said tray comprising an extruded plastics profile having locating ribs at two opposing sides of the profile.

12. A punch as set forth in claim 8 further including a paper guage mounted in said base portion for sliding extension therefrom, said paper gauge comprising an elongate element which is T-shaped in cross-section and which has a series of notches formed therein and engageable with an edge of said base portion enabling stepwise adjustment of its extension from said base portion.

13. A punch as set forth in claim 2 wherein said base portion is aluminium and said support portion is plastics material.

14. A punch as set forth in claim 2 wherein said base portion is plastics material and said support portion is aluminium.

15. A punch as set forth in claim 1 wherein said base portion is defined by a first extruded profile;

said support portion being defined by a second extruded profile, said profiles having matching projection and recess means for interengagement such that said support portion extends upwardly from said base portion.

16. A punch as set forth in claim 1, wherein said base portion and said support portion are integral and defined by a single extrusion.

17. A method of making a punch having an elongate base portion and an overlying elongate support portion with a paperreceiving throat area defined between said portions, cutting tool means for traversing said throat area and cutting received paper, and a press bar overlying said support portion and engaging said cutting tool means for cutting manipulation thereof;

said method including the steps of extruding said base portion and forming a uniform cross-section base profile with opposed free ends, extruding said support portion and forming a uniform cross-section support profile with opposed free ends, providing a pair of end plates, and mounting said extruded base and support portions between said end plates with said end plates engaging the opposed free ends of the base and support portions and rigidifying said portions.

18. The method of claim 17 including the steps of extruding said press bar and forming a uniform cross-section press bar profile with opposed free ends, and mounting said press bar between said end plates with said end plates engaging the opposed free ends of the press bar and defining movement limiting means thereof.

19. The method of claim 18 wherein said base portion and said support portion are integrally extruded as a single member.

20. The method of claim 18 wherein said base portion and said support portion are separately extruded and subsequently joined prior to mounting between said end plates.

* * * * *